United States Patent [19]

Hirosawa et al.

[11] Patent Number: 5,044,907

[45] Date of Patent: Sep. 3, 1991

[54] ROTOR DEVICE HAVING INNER ROTOR AND DRIVEN OUTER ROTOR

[75] Inventors: Koichiro Hirosawa, Kariya; Takashi Ohmitsu, Toyota; Masahiro Fukuta, Nagoya, all of Japan

[73] Assignee: Aisin Seiki Kabushiki Kaisha, Kariya, Japan

[21] Appl. No.: 568,629

[22] Filed: Aug. 16, 1990

Related U.S. Application Data

[63] Continuation of Ser. No. 251,808, Sep. 30, 1988, abandoned.

[30] Foreign Application Priority Data

Sep. 30, 1987 [JP] Japan ..... 62-246736

[51] Int. Cl.[5] ..... F04C 18/10

[52] U.S. Cl. ..... 418/168

[58] Field of Search ..... 418/166-171

[56] References Cited

U.S. PATENT DOCUMENTS

| | | | |
|---|---|---|---|
| 724,665 | 4/1903 | Cooley | 418/168 |
| 4,714,417 | 12/1987 | Wankel | 418/166 |
| 4,801,255 | 1/1989 | Wankel | 418/168 |

FOREIGN PATENT DOCUMENTS

| | | | |
|---|---|---|---|
| 2918369 | 11/1980 | Fed. Rep. of Germany | 418/168 |
| 1135996 | 12/1956 | France | 418/168 |
| 61-4802 | 1/1986 | Japan . | |
| 404846 | 1/1934 | United Kingdom | 418/171 |

*Primary Examiner*—John J. Vrablik

*Attorney, Agent, or Firm*—Burns, Doane, Swecker & Mathis

[57] ABSTRACT

A rotor device includes a casing, an outer rotor positioned in the casing and rotatable about a first rotational axis, and an inner rotor positioned in the casing and rotatable about a second rotational axis. An outer sealing portion of the inner rotor defines a locus along an inner wall surface of an operating chamber of the outer rotor as a result of the rotation of the inner rotor. An inner sealing portion of the outer rotor defines a locus along an outer circumferential surface of the inner rotor in response to the rotation of the outer rotor. The inner wall surface of the operating chamber engages the outer circumferential surface of the inner rotor through a gear engagement. A driving input shaft portion is connected to the outer rotor and a first gear having teeth on its inner circumferential surface is connected to the outer rotor. A second gear having teeth on its outer circumferential surface is connected to the inner rotor and is engaged with the first gear, whereby the inner rotor is driven by the outer rotor via the first and second gears.

10 Claims, 5 Drawing Sheets

ROTOR DEVICE HAVING INNER ROTOR AND DRIVEN OUTER ROTOR

This application is a continuation of application Ser. No. 251,808, filed Sept. 30, 1988, abandoned.

BACKGROUND OF THE INVENTION

1. Field of the Invention

This invention relates generally to a rotor device, and more particularly to a rotor device for use as a compressor in a supercharger that is driven at high rotational speeds.

2. Description of the Prior Art

Generally, a prior art rotor device that increases the quantity of air discharged as a result of a decrease in the dead space in the rotor is disclosed in Japanese Patent Laid-open No. 61(1986)-4802 published on Jan. 10, 1986. As shown in FIG. 4, the rotor device of the prior art includes outer and inner rotors 120 and 130 that are disposed within a casing 100 and that rotate around their respective rotational axes. In response to rotation of the outer and inner rotors 120, 130, the outer sealing portion of the inner rotor 130 defines a locus along an inner wall surface of the operating chamber of the outer rotor 120.

An inner sealing portion of the outer rotor 120 defines a locus along an outer circumferential surface of the inner rotor 130 as a result of rotations of the outer and inner rotors 120 and 130. The outer circumferential surface of the inner rotor 130 engages the inner wall surface forming an operating chamber of the outer rotor 120 through a gear engagement. Since the input pulley 131 is connected to the inner rotor 130, the outer bearing 121 for the outer rotor 120 must be arranged at the outer circumferential portion of the rotating shaft of the inner rotor 130. As a result of that arrangement, the inner diameter of the bearing 121 is large. Accordingly, when the rotors 120 and 130 are rotated at a high speed, the bearing 121 becomes worn and, therefore, its useful life is shortened. Thus, the prior art rotor device is not entirely satisfactory.

SUMMARY OF THE INVENTION

One of the objects of the present invention is to provide an improved rotor device that overcomes the foregoing disadvantages of the prior art.

Another object of the present invention is to provide an improved rotor device, wherein an inner diameter of a bearing for supporting the outer rotor is smaller than in the prior art rotor devices, whereby the useful life of the rotor is increased.

To accomplish these and other objects, the rotor device includes an outer rotor positioned within a casing and adapted to rotate around a first rotational axis and an inner rotor positioned in the casing and adapted to rotate around a second rotational axis. As a result of the rotation of the inner rotor, an outer sealing portion of the inner rotor defines a locus along an inner wall surface of an operating chamber of the outer rotor. As a result of the rotation of the outer rotor, the inner sealing portion of the outer rotor defines a locus along an outer circumferential surface of the inner rotor. The inner wall surface of the operating chamber engages the outer circumferential surface of the inner rotor through a gear engagement. Further, a driving input shaft portion is connected to the outer rotor and a first gear having teeth on its outer circumferential surface is connected to the inner rotor and engaged with a second gear. The inner rotor is driven by the outer rotor via the first and second gears.

In the rotating device according to the present invention, the outer rotor has a shape that covers the inner rotor along an outer circumferential surface and side wall surface of the inner rotor. Since the driving input shaft is connected to the outer rotor, the diameter of an outer bearing for outer rotor is smaller than in the prior art.

BRIEF DESCRIPTION OF THE DRAWINGS

Various other objects, features and advantages of the present invention will be more fully appreciated as the present invention becomes better understood from the following detailed description when considered in connection with accompanying drawings, wherein.

DETAILED DESCRIPTION OF THE PREFERRED EMBODIMENTS

Figure 1:
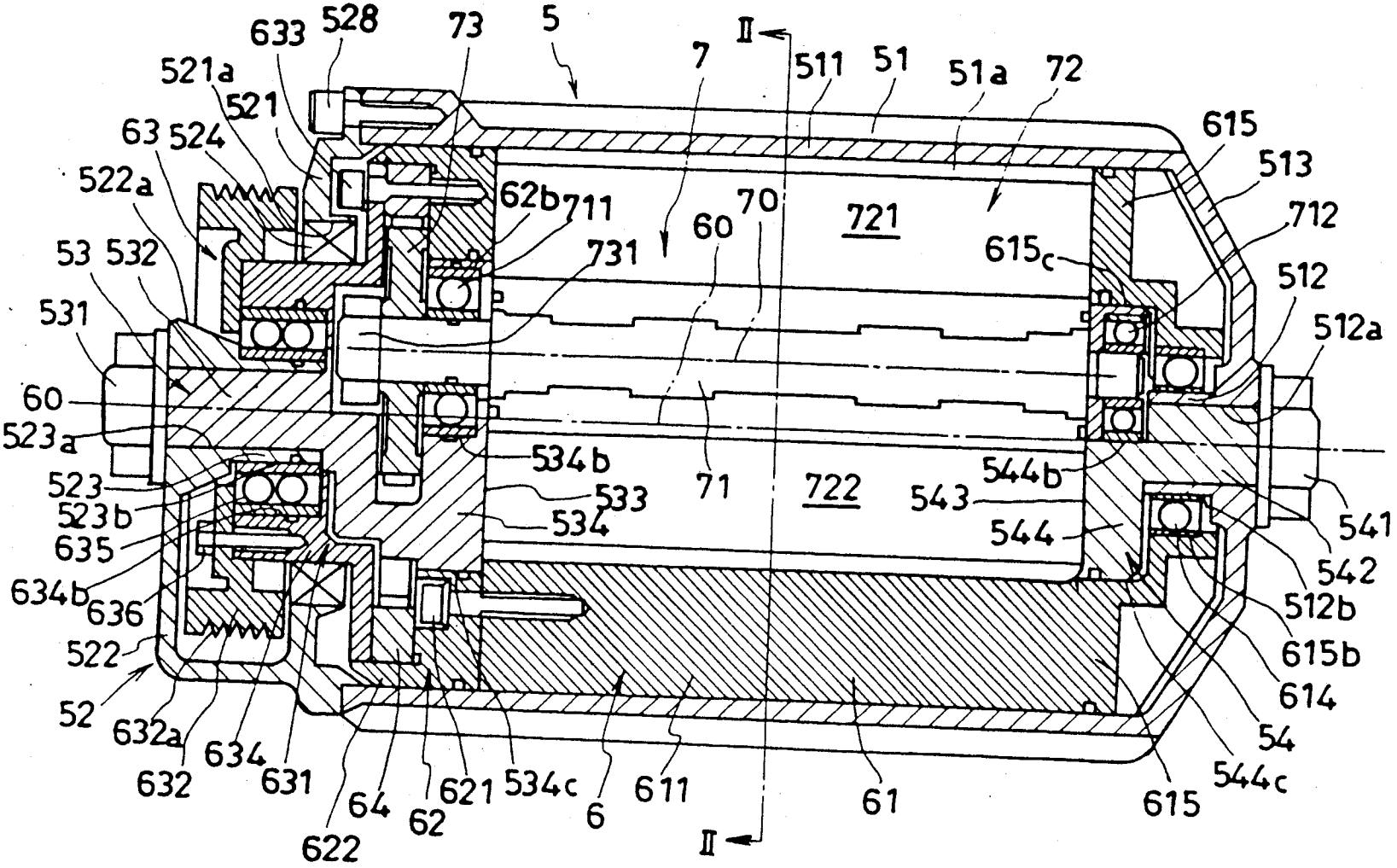
FIG. 1 is a longitudinal sectional view of one embodiment according to the present invention.

Referring initially to FIG. 1, the rotor device of the present invention includes a casing 5 and outer and inner rotors 6 and 7 arranged in the casing 5.

The casing 5 includes a base portion 51, a cover portion 52 for covering one end of the base portion 51, a front shaft portion 53 fixed to the cover portion 52 and a rear shaft portion 54 fixed to other end of the base portion 51.

Figure 2:
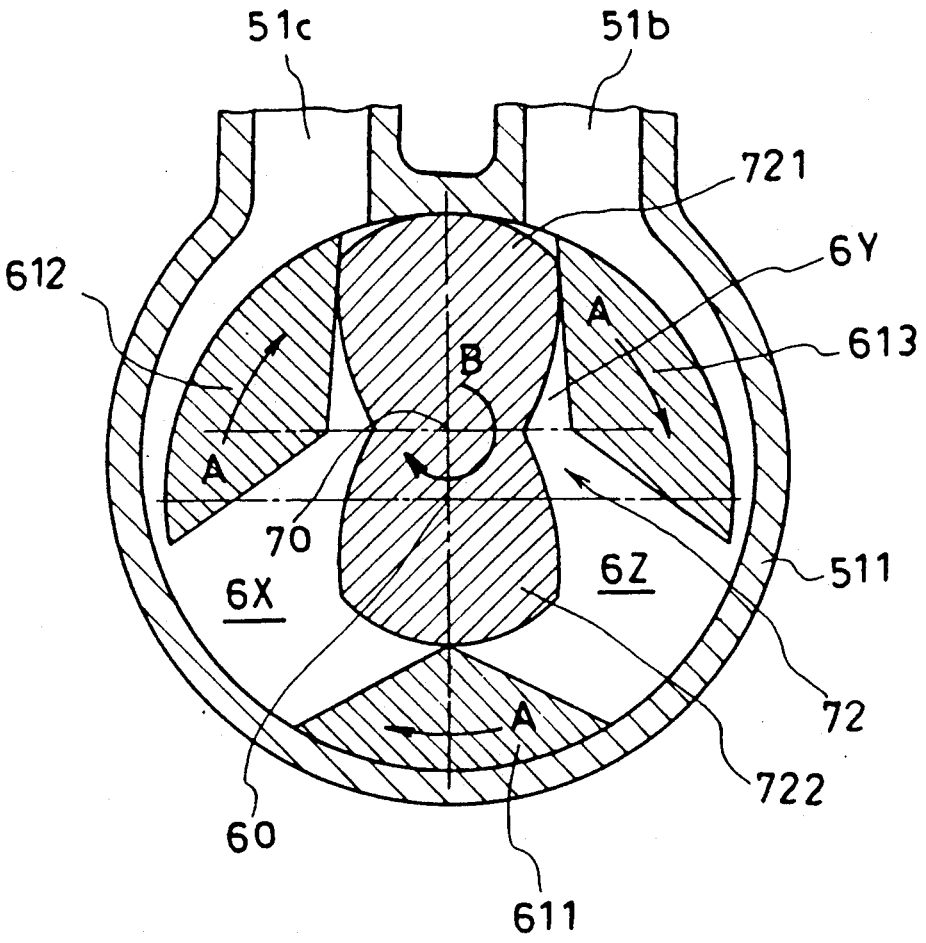
FIG. 2 shows a sectional view taken along line II—II in FIG. 1.

The base portion 51 includes an inlet **51*b*, an outlet 51*c* and a body portion 511 for forming a column shaped space 51*a* as shown in FIG. 2. The base portion 51 also includes a bottom portion 513 having a boss portion 512 extending therefrom. The boss portion 512 has a centrally located hole 512*a* extending therethrough. A bearing surface 512*b* is formed on an outer surface of the boss portion 512**.

The cover portion 52 is fixed to a front end of the base portion 51 by a bolt 528. The cover portion 52 includes an inner cap portion 521 having a large hole **521*a* extending through a central portion thereof, an outer cap portion 522 unitarily formed with the inner cap portion 521 and having a large opening 522*a* therein, and a boss portion 523 formed on the outer cap portion 522 and having a central hole 523*a* therein. The outer circumferential surface of the boss portion 523 constitutes a bearing surface 523*b* that has an O-ring positioned therearound. The outer circumferential surface of the boss portion 512 also constitutes a bearing surface 512*b*. The boss portions 523 and 512 together define a first shaft portion having a first rotational axis 60. A ring-shaped sealing member 524 is fixed in the hole 521*a* of the inner cap portion 521**.

The front shaft portion 53 is inserted into the central hole **523*a* and fixed to the cover portion 52 by a bolt 531. The front shaft portion 53 includes a shaft portion 532, a sealing portion 533 formed at a rear end of the shaft portion 532 and an end portion 534 having a diameter larger than that of the shaft portion 532. The inner circumferential surface of the end portion 534 constitutes a bearing surface 534***b* having a sealing member positioned therearound. The outer circumferential surface of the end portion 534 also defines a bearing surface 534*c*.

The rear shaft portion 54 is inserted into the central hole 512*a* and is fixed to the bottom portion 513 by a bolt 541. The rear shaft portion 54 includes a shaft portion 542, a sealing portion 543 formed at a front end thereof and an end portion 544 having a diameter larger than that of shaft portion 542. The inner circumferential surface of the end portion 544 defines a bearing surface 544*b* and the outer circumferential surface of the end portion 544 also defines a bearing surface 544*c* having a sealing member positioned therearound.

The outer rotor 6 includes an outer rotor body 61 inserted in the space 51*a* in casing 5, a positioning member 62 fixed to the outer rotor body 61, an input driving shaft portion 63 and a gear 64. Gear teeth are located on the inner circumferential surface of gear 64. The input driving shaft portion 63 has a connecting member 631 fixed to the positioning member 62, and a pulley 632. The gear 64 is supported between the connecting member 631 and the positioning member 62.

An outer sealing portion of the outer rotor body 61 seals the bottom and top surfaces of the base portion 51 in the casing 5 in accordance with rotation of the outer rotor 6 around the first rotational axis 60. The outer rotor body 61 includes three outer rotor portions 611, 612 and 613, and a ring-shaped end portion 615 having a sealing ring positioned therearound. The ring-shaped end portion 615 is rotatably supported on the end portion 544 and the shaft portion 542. Each inner sealing portion of the outer rotor body 61 draws a locus along an outer circumferential surface of the inner rotor 7. A bearing surface 615*b* is formed on an inner surface of the end portion 615. The inner surface of the end portion 615 is rotatably supported via an outer bearing 614 that is arranged between bearing surfaces 615*b* and 512*b*. A bearing surface 615*c* having a sealing ring positioned therearound is formed on an inner surface of the end portion 615 and faces the bearing surface 544*c*. Operating chambers 6X, 6Y and 6Z are formed between the outer rotor portions 611, 612 and 613.

The positioning member 62 is ring-shaped and is fixed to the outer rotor portions 611, 612 and 613 by a bolt 621. The positioning member 62 includes a projecting portion 622 and sealing members at outer and inner circumferential surfaces thereof. The inner circumferential surface of the positioning member 62 forms a bearing surface 62*b* that faces the bearing surface 534*c*.

The gear 64 is supported by the projecting portion 622 of positioning member 62 and is fixed to the positioning member 62 by a bolt 633. The connecting member 631 is ring-shaped and has a bearing portion 634. An inner circumferential surface of the bearing portion 634 forms a bearing surface 634*b* for an outer bearing 635. The outer bearing 635 also bears upon the bearing surface 523*b*. The bearing surface 634*b* has a sealing member positioned therearound.

The pulley 632 is ring-shaped and has a ribbed portion 632*a* on its exterior surface. The pulley 632 is fixed to the bearing portion 634 of connecting member 631 by a bolt 636.

The inner rotor 7 includes an inner shaft portion 71 that defines a second shaft portion having a second rotational axis 70 that is parallel to the first rotational axis 60 in the longitudinal direction. The inner rotor 7 further includes an inner rotor body 72 fixed to the inner shaft portion 71 and inserted within the rotational circumference of the outer rotor 6. A gear 73 having teeth on its outer circumferential surface is fixed to one end of the inner shaft portion 71.

The inner shaft portion 71 is rotatably supported by an inner bearing 711 arranged between the bearing surfaces 62*b* and 534*b* and another inner bearing 712 arranged between the bearing surfaces 615*c* and 544*b*. The inner rotor body 72 is fixed to the inner shaft portion 71 between bearings 711 and 712. An outer sealing portion of the inner rotor body 72 defines a locus along an inner wall surface of the operating chambers 6X, 6Y and 6Z of the outer rotor 6 as a result of the rotation of the inner rotor body 72 around the second rotational axis 70. An outer circumferential surface of the inner rotor body 72 engages each inner wall surface of the operating chambers 6X, 6Y and 6Z of the outer rotor 6 through a gear engagement. As shown in FIG. 2, the inner rotor portions 721 and 722, each having sealing rings at both sides, are formed on the inner rotor body 72.

The gear 73, having teeth on its outer circumferential surface, is fixed to one end of the inner shaft portion 71 by a bolt 731. The teeth on the gear 73 engage the teeth on the gear 64.

The assembling steps of the rotating device according to the present invention are as follows. The outer rotor body 61 is inserted into the base portion 51 of casing 5 via outer bearing 614 and the rear shaft portion 54 is inserted into the outer rotor body 61 and fixed to the base portion 51 by the bolt 541. The inner shaft portion 71 which is mounted to the inner rotor portion 721 is then inserted into the outer rotor body 61 and the positioning member 62 is inserted into the outer rotor body 61 and fixed to the outer rotor body 61 by the bolt 621. Next, the bearing 711 is mounted on the inner shaft portion 71, the end portion 534 of the front shaft portion 53 which is supported by the gear 73 is inserted into the positioning member 62 to mount the gear 73 on the inner shaft portion 71 and the gear 73 is fixed to the inner shaft portion 71 by the bolt 731. The gear 64 and the connecting member 631 are then inserted into the positioning member 62 and fixed to the positioning member 62 by the bolt 633. Next, the outer bearing 635 is inserted into the connecting member 631. The pulley 632 is supported between the front and rear cap portions 521 and 522 of the cover portion 52 and the pulley 632 and the cover portion 52 are mounted on the connecting member 631. Further, the pulley 632 is fixed to the connecting member 631 by the bolt 636 while the cover portion 52 is fixed to the base portion 51 of the casing 5 by the bolt 528. Finally, the bolt 531 is fastened.

The operation of the rotating device according to the present invention is as follows. Through rotation of the pulley 632, the connecting member 631, the outer rotors 611, 612 and 613 and the gear 64 are rotated around the first rotational axis 60 in the direction indicated by the arrows A in FIG. 2. Due to the small inner diameter of the outer bearings 635 and 614, high speed rotation of the outer rotor 6 is not problematic. The gear 73 and the inner rotor 7 are rotated by rotation of the gear 64, whereby the inner shaft portion 71 and inner rotor portions 721 and 722 are rotated about the second rotational axis 70 in the direction indicated by arrow B in FIG. 2. Due to the small inner diameter of the inner bearings 711 and 712, high speed rotation of the inner rotor is not problematic. When the outer rotor 6 and the inner rotor 7 rotate as described above, the rotational speed ratio is 2:3 due to the gear ratio of the outer rotor 6 to the inner rotor 7. Accordingly, air is sucked into the operating chambers 6X, 6Y, 6Z from inlet 51*b* of casing 5 in response to the rotational speed of the rotors 6 and 7. The volume of the chambers 6X, 6Y, 6Z is decreased in accordance with the rotation of the outer rotor 6 and the inner rotor 7 whereby air under high pressure is discharged from outlet 51*c* of casing 5. As described above, the rotating device according to the present invention can be used as a compressor in a supercharger that is operated at high rotational speeds.

Figure 3:
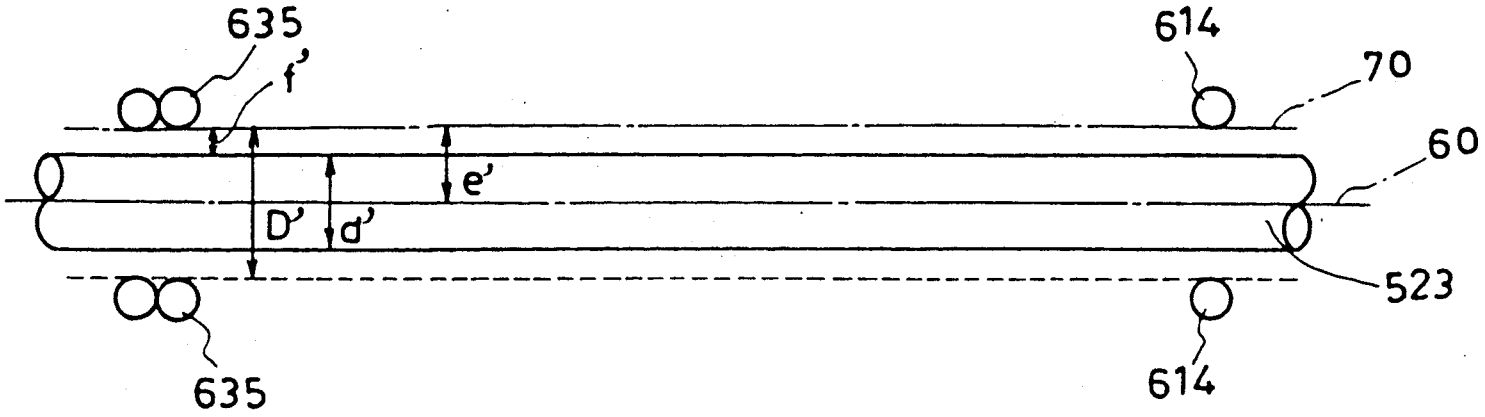
FIG. 3 is a diagram showing the positioning of some of the parts of the rotor device of the present invention.
Figure 4:
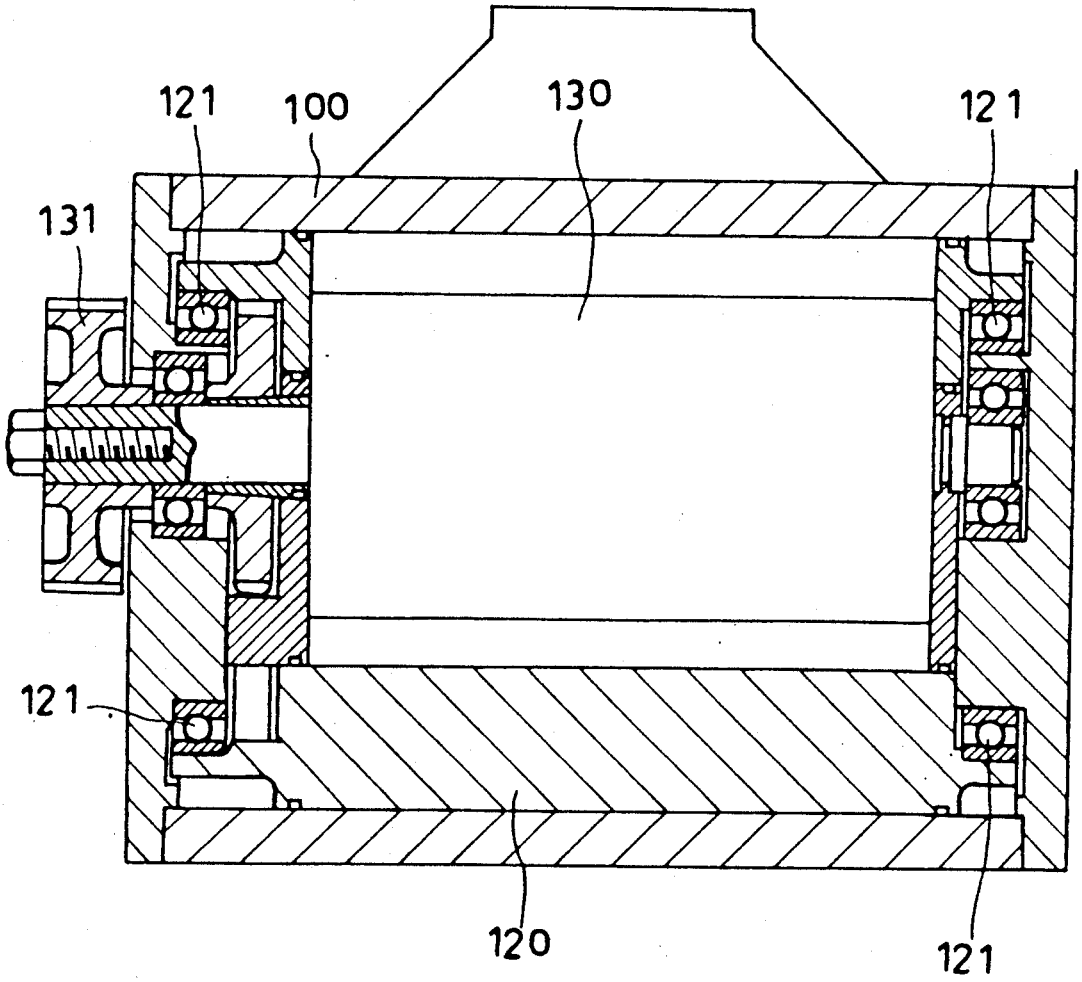
FIG.4 PRIOR ART
FIG. 4 is a longitudinal sectional view of a prior art rotor device.
Figure 5:
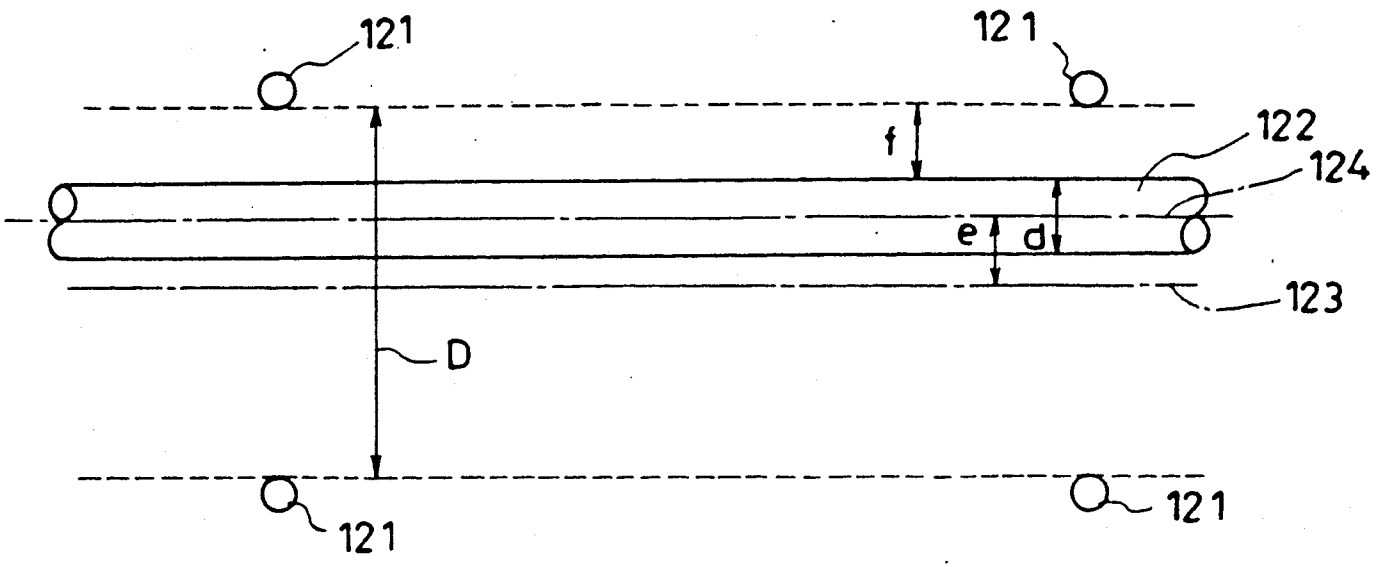
FIG. 5 PRIOR ART
FIG. 5 is a diagram showing the positioning of some of the parts of the rotor device of the prior art.

With reference to FIGS. 3 and 5, the advantages of the smaller inner diameter of the outer bearing of the present invention over the prior art will be explained.

FIG. 5 shows the positional relationship between some of the features of the rotor device of the prior art, wherein the meaning of each symbol is as follows:

d: the inner diameter of the shaft portion 122 of the inner rotor 130;

e: the difference between the rotational axes 123 and 124 of the outer and the inner rotors 120 and 130;

f: the distance between the shaft portion 122 of the inner rotor 130 and the outer bearing 121;

D: the inner diameter of outer bearing 121. Accordingly, $$D/2 \geqq d/2+e+f \quad (1).$$

Consequently, the inner diameter D of the outer bearing 121 is quite large.

FIG. 3 shows the positional relationship between some of the features of the rotor device of the present invention, wherein the meaning of each symbol is as follows:

d': the inner diameter of the first shaft portion 523 of the outer rotor 6;

e': the distance between the rotational axes 60 and 70 of the outer and inner rotors 6 and 7;

f': the distance between the first shaft portion 523 of the outer rotor 6 and the outer bearing 635 (or 614);

D': the inner diameter of the outer bearing 635 (or 614). Accordingly, $$D'/2 > d'/2+f \quad (2)$$

Consequently, it can be seen by comparing equations (1) and (2) that the inner diameter D' of the outer bearing 635 (or 614) of the present invention is smaller than the inner diameter D of the outer bearing 121 of the prior art.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A rotor device for use as a compressor in a supercharger comprising:

a casing;

an outer rotor positioned in said casing and partially defining an operating chamber, a first boss portion integral with a cover of the casing and a second boss portion integral with a bottom portion of the casing rotatably supporting said outer rotor through a bearing arrangement for rotation about a first rotational axis, said outer rotor including an outer rotor body connected to a positioning member, said positioning member having a bearing surface;

an inner rotor having an outer circumferential surface positioned in said casing and rotatably supported about a second rotational axis by an inner shaft through a bearing arrangement positioned at opposite ends of said inner shaft;

an outer sealing portion of said inner rotor defining a locus along an inner wall surface of an operating chamber of said outer rotor as a result of the rotation of said inner rotor;

an inner sealing portion of said outer rotor defining a locus along an outer circumferential surface of said inner rotor as a result of the rotation of said outer rotor;

said inner wall surface of said operating chamber being engaged with said outer circumferential surface of said inner rotor through a gear engagement comprising a first gear and a second gear;

an input driving shaft portion connected to said outer rotor;

a front shaft portion including an end portion, said end portion of said front shaft portion having a bearing surface on its inner circumferential surface, and an inner bearing positioned between the bearing surface on said positioning member and the bearing surface on the end portion of the front shaft portion so as to rotatably support one end of said inner rotor;

said first gear having teeth on its inner circumferential surface and connected to said outer rotor;

said second gear having teeth on its outer circumferential surface, said second gear being connected to said inner rotor and being engaged with said first gear; and said inner rotor being driven by said outer rotor via said first and second gears.

2. A rotor device of claim 1, wherein said driving input shaft portion includes a pulley.

3. A rotor device in accordance with claim 1, wherein said first gear is connected to said positioning member.

4. A rotor device in accordance with claim 1, wherein a connecting member is fixed to said positioning member and is connected to said pulley.

5. A rotor device in accordance with claim 4, wherein said connecting member includes a bearing portion having a bearing surface on its inner circumferential surface, said casing including a base portion and said cover portion for covering one end of the base portion, said cover portion including said second boss portion having a bearing surface on its outer circumferential surface.

6. A rotor device in accordance with claim 5, and further comprising an outer bearing positioned between the bearing surface on said second boss portion of said cover portion and the bearing surface on the bearing portion of said connecting member.

7. A rotor device in accordance with claim 5, wherein the base portion includes said bottom portion provided with said first boss portion extending therefrom, said first boss portion of aid bottom portion having a bearing surface on its outer circumferential surface, said outer rotor including an outer rotor body and said outer rotor body having a ring-shaped end portion, the ring-shaped end portion having a bearing surface on its inner circumferential surface.

8. A rotor device in accordance with claim 7, and further comprising an outer bearing positioned between the bearing surface on said first boss portion of said bottom portion and the bearing surface on the ring-shaped end portion of said outer rotor body.

9. A rotor device in accordance with claim 1, wherein said casing includes a base portion, a cover portion for covering one end of the base portion, a front shaft portion fixed to the cover portion at one end of the base portion and a rear shaft portion fixed to an opposite end of the base portion.

10. A rotor device in accordance with claim 9, wherein said rear shaft portion includes an end portion, the end portion of said rear shaft portion having a bearing surface on its inner circumferential surface, said outer rotor including an outer rotor body and said outer rotor body including a ring-shaped end portion, the ring-shaped end portion having a bearing surface on its inner circumferential surface, the device further comprising an inner bearing positioned between the bearing surface on the ring-shaped end portion of said outer rotor body and the bearing surface on the end portion of said rear shaft portion for rotatably supporting one end of an inner shaft portion of said inner rotor.

* * * * *